United States Patent [19]

Berry

[11] 4,156,894

[45] May 29, 1979

[54] LIGHT FITTING

[75] Inventor: Desmond J. Berry, Mount Eliza, Australia

[73] Assignee: Dega Proprietary Limited, Braeside, Australia

[21] Appl. No.: 773,293

[22] Filed: Mar. 1, 1977

Related U.S. Application Data

[63] Continuation-in-part of Ser. No. 628,478, Nov. 4, 1975, abandoned.

[51] Int. Cl.[2] ..... F21V 31/00

[52] U.S. Cl. ..... 362/267; 362/457

[58] Field of Search ..... 362/267, 263, 16, 21, 362/72, 84, 157, 158, 255, 257, 376, 256, 368

[56] References Cited

U.S. PATENT DOCUMENTS

| | | | |
|---|---|---|---|
| 486,729 | 11/1892 | Miller | 362/255 |
| 2,707,747 | 5/1955 | De Frees | 362/267 |
| 2,935,601 | 5/1960 | Steiner et al. | 362/267 |
| 3,244,869 | 4/1966 | Buck | 362/267 X |
| 3,474,243 | 10/1969 | Miller | 362/267 X |
| 3,636,341 | 1/1972 | Miller | 362/263 |
| 3,949,212 | 4/1976 | Larrimore | 362/263 |
| 3,949,213 | 4/1976 | Pritchell | 362/101 |

*Primary Examiner*—William M. Shoop
*Assistant Examiner*—Peter S. Wong
*Attorney, Agent, or Firm*—Olson, Trexler, Wolters, Bushnell & Fosse, Ltd.

[57] ABSTRACT

A light fitting for underwater use is of reduced size and is structured to provide easy and ready replacement of the fitting lamp. The fitting includes a housing, a disc-shaped backing plate mounted to the housing and a lens sealingly connected to the backing plate and forming therewith an enclosed chamber. A gland housing is sealingly connected in the backing plate and forms an enclosed chamber opening. An electrical connector which supports the fitting lamp is dimensioned for passing through the gland housing and is connectable to electrical power for powering the lamp by a cable which also extends into the gland housing. A seal bushing surrounds the cable within the gland housing and provides a tight seal between the cable and gland housing when acted upon by a nut which also surrounds the cable and which threadingly engages the gland housing. Ready removal of the lamp for replacement is provided by removing the nut from the gland housing and pulling the cable and the lamp through the gland housing.

11 Claims, 8 Drawing Figures

LIGHT FITTING

RELATED APPLICATION

This is a continuation-in-part of application Ser. No. 628,478, filed on Nov. 4, 1975, now abandoned.

BACKGROUND OF THE INVENTION

This invention relates to light fittings and refers particularly, though not exclusively, to light fittings for use in swimming pools.

For many years lights have been provided in in-the-ground swimming pools by being built into the wall. These lights have all used incandescent lamps and glass covers to protect the lamps. The use of glass covers results in no control over light output and hence the light fitting illuminates the pool and all surrounds. The resultant glare can dazzle people using the pool and thus cause accidents. Furthermore, to replace the lamp normally required the fitting to be completely removed and completely dissembled. This is, naturally, of great annoyance to users.

Examples of the prior art systems are shown in U.S. Pat. Nos. 3,337,725 of Nash and 3,339,066 of Hart, the Nash specification discloses a system whereby the light source is located remote from the swimming pool and a tube with reflectors is used to transmit the light to the swimming pool wall. This solved two great problems—the sealing of the lens under water, and the accessability of the light source. Unfortunately, the operation of the light was extremely inefficient due to the reduction in light at the reflective surfaces, and the cost of installation was extremely high. Furthermore, the actual light source assembly was complex and bulky with the resultant difficulty in handling and maintenance by an untrained person.

The Hart specification discloses an underwater light of rather conventional construction except that a sealed beam lamp is used. In doing this, the actual housing need not be waterproof—only the electrical connections need be waterproofed. This was done by the use of an epoxy resin. The only difference between the Hart fitting and the standard prior fitting was the use of a sealed beam lamp rather than an incandescent lamp and a multi-part assembly to house that lamp.

Neither of these provide a relatively compact and efficient unit which is easily maintained by an untrained person and which eliminates complex structures required for sealing the electrical connections.

Furthermore, neither of the above prior art specifications disclose a light fitting for underwater use wherein there is provided a lens whereby the light emanating from the lamp is diffused so as to prevent unnecessary glare from the light fitting. Lenses of this general nature are known. For example, U.S. Pat. No. 2,033,381 of Koubek et al shows an automotive light with a lens having a number of flutes or ribs on its internal surface which are designed to diffuse the light. U.S. Pat. No. 2,916,607 of Bargman also shows an automotive light with a lens having a number of concentric ribs on its internal surface which are also designed to diffuse the light. The lenses of the Koubek and Bargman specifications are both of the general nature of 'ring optics' as are shown in U.S. Pat. No. 1,916,514 also of Koubek, where prisms on one surface of the lens and flutes on the other are arranged to totally diffuse all light.

DESCRIPTION OF THE INVENTION

It is therefore the principal object of the present invention to provide a light fitting that is of small relative dimensions and is more efficient than previous light fittings.

Another object of the present invention is to provide a light fitting wherein the direction of the light output is controlled so as to reduce glare.

Still another object of the present invention is to provide a light fitting whereby the lamp is easily changed.

With the above and other objects in mind, the present invention provides a light fitting for underwater use comprising a housing, a backing plate mountable to said housing, a gland housing sealingly connected in said backing plate, an electrical cable releasably mountable in said gland housing, sealing means comprising a nut surrounding said cable and threadedly engaging said gland housing, a saucer-shaped washer and a sealing bush surrounding said cable and clamped by said nut, said sealing bush having a sealing fit in an end portion of said gland housing and over said cable, said cable being for supplying electrical power to a quartz halogen lamp located adjacent said gland housing.

If desired, there may be provided a mirror behind the light source, preferably a cylindrical mirror, so as to increase the light output. Also, the lamp may be placed in the light fitting such that its main light axis is angled downwardly with respect to the horizontal axis.

Advantageously, the backing plate is somewhat saucer shaped with the housing including a flat, back plate.

DESCRIPTION OF PREFERRED EMBODIMENTS

So that the invention may be clearly understood and readily put into practical effect there will now be described, with reference to the accompanying illustrative drawings, preferred constructions of light fittings according to the present invention. In the drawings.

Figure 1:
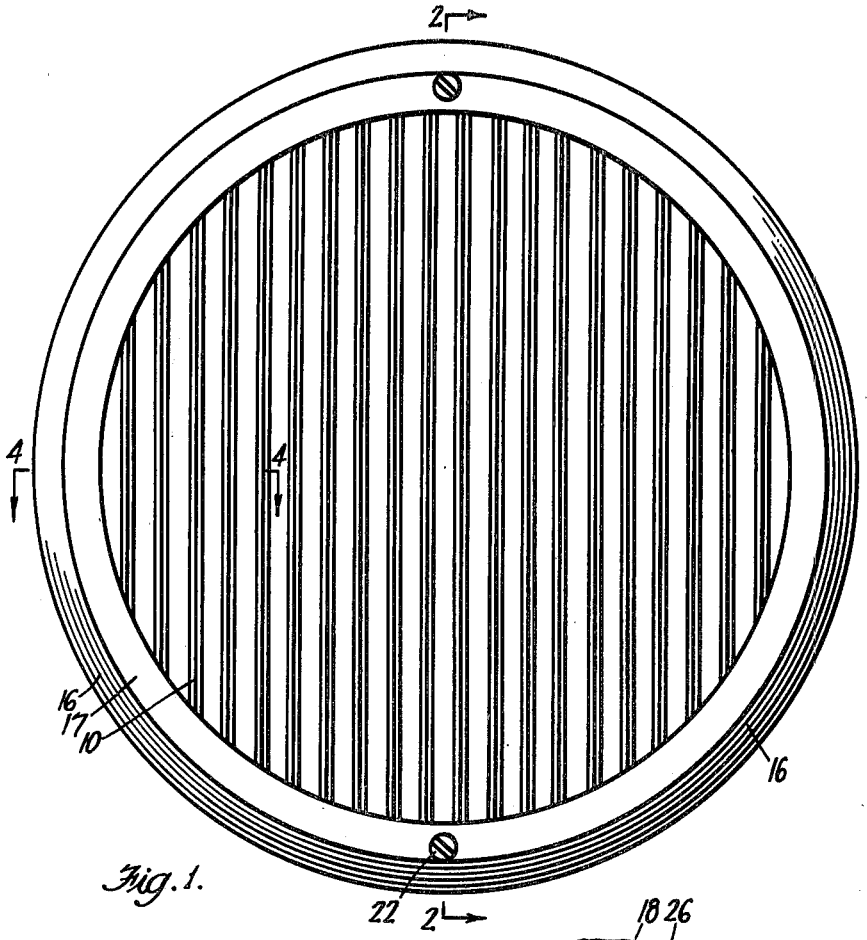
FIG. 1 is a front view of a first embodiment.
Figure 4:
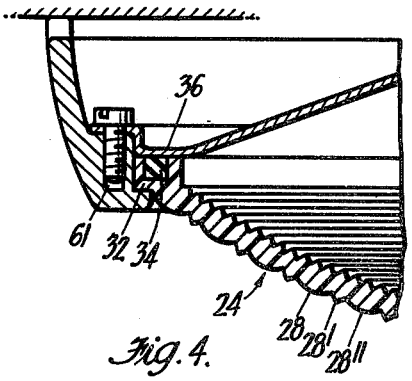
FIG. 4 is a cross-section along the lines of and in the direction of arrows 4—4 of FIG. 1.
Figure 5:
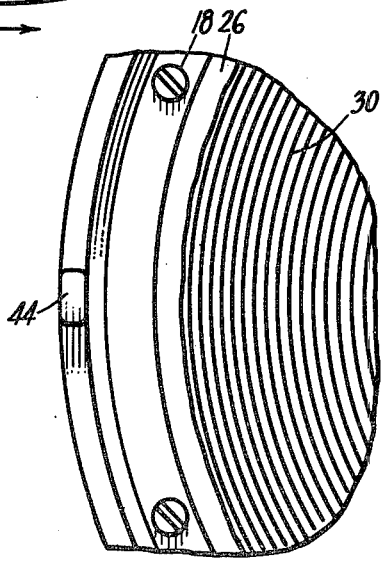
FIG. 5 is a rear view of a portion of the first embodiment.
Figure 3:
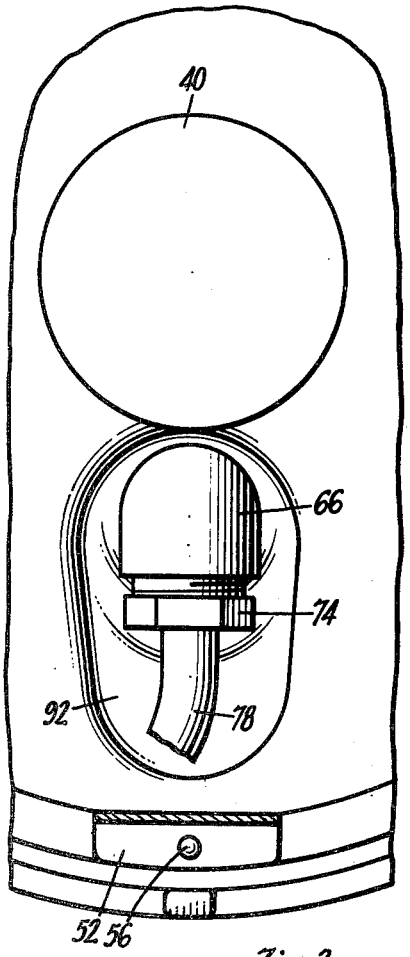
FIG. 3 is a full cross-section along the lines of and in the direction of arrows 3—3 of FIG. 2.
Figure 2:
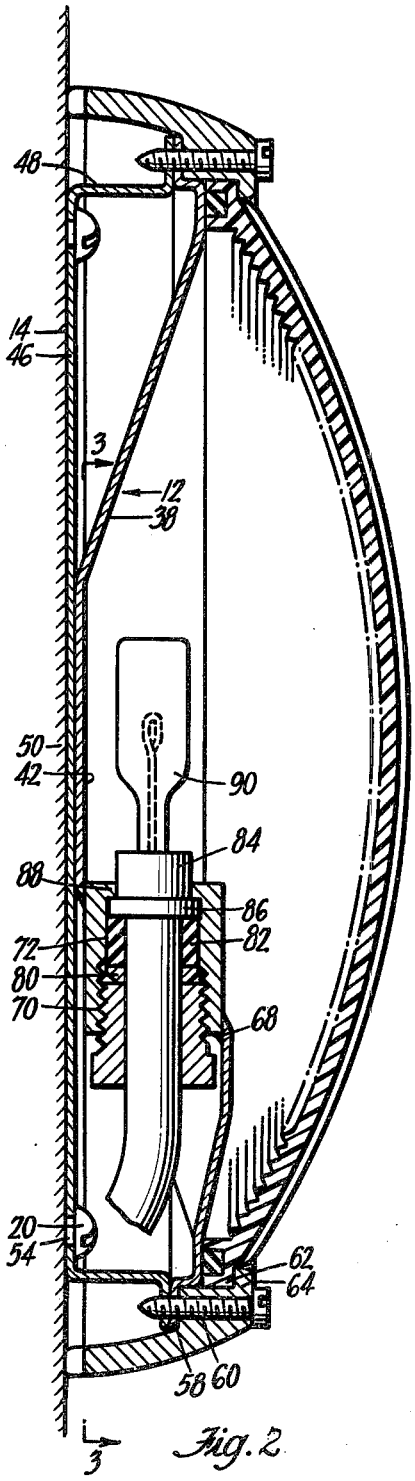
FIG. 2 is a cross-section along the lines of and in the direction of arrows 2—2 of FIG. 1.

To firstly refer to the embodiment of FIGS. 1 to 5, there is shown a light fitting for use in swimming pools and which basically comprises a lens 10, a base plate 12, a mounting bracket 14 and a housing 16.

The lens 10 is made of clear glass or plastics material and is shaped like a segment of a sphere. The outer surface 24 of the lens has a number of vertically extending parallel waves 28 which are of alternating peaked construction 28' and rounded construction 28'' whilst the inner surface 26 has a number of outstanding concentric rings 30. The lens 10 is also provided with a peripheral slot 32 which accommodates a seal 34, such as, for example, an O-ring.

The base plate 12 is of a general saucer shape and has a side wall 38, a flat base 40, and a peripheral flange 36. The inner surface 42 of base 40 is preferably provided with a reflective finish whilst flange 36 is provided with a number diametrically opposed holes 58.

The housing 16 is shaped somewhat like a truncated cone with a peripheral flange 17 at its outer end and a plurality of lugs 44 at the inner end. Two diametrically opposed holes 60 pass through flange 17 whilst there are a number of diametrically opposed holes 61 into the flange 17.

The mounting bracket 14 generally consists of a rectangular base 46 with outstand end walls 48 and flanges 52 at the outermost end of walls 48. Holes 54 are provided in the base 46 and holes 56 are provided in flanges 52.

The apparatus is assembled by placing lens 10 in position with flat surface 62 resting against surface 64 of flange 17. The base plate 12 is then placed in position with flange 36 resting against the seal 34. Screws 18 passing through holes 58 in base plate 12 and into holes 61 in flange 17 are then used to secure the lens 10, base plate 12 and housing 16 in a sealed assembled relationship.

A lamp 90 is connected to an electrical connecting element 84 which has power supplied thereto by an electrically conducting cable 78. Surrounding the cable are an elongate screw threaded nut 74, a metal washer 80 of somewhat saucer shape and a sealing bush 82 of predetermined outer diameter and which is a sealing fit over the cable 78. The lamp 90 is placed inside the fitting by passing it through an opening in an approximately cylindrically shaped gland housing 66 which is sealingly secured to wall 38 by welds 68. A peripheral ridge 86 on element 84 co-operates with a flange 88 at the inner end of housing 66 to locate the lamp 90 in the fitting. The nut 74 is then screwed into a screw-threaded portion 70 of housing 66 and thus forces the washer 80 against the seal 82 and thus forces the seal into end portion 72 of housing 66. The end portion 72 may taper slightly inwardly if desired. The external diameter of seal 82 is such it creates a water-tight seal in end portion 72. A flat portion 92 is provided in wall 38 adjacent housing 66 to enable the lamp 90 to be easily inserted and removed.

The assembly of lens 10, base plate 12, housing 16 and lamp 90 is then secured to the mounting bracket 14 by means of screws 22 passing through holes 60 in housing 16 and into holes 56 of flanges 52 of the bracket 14, the bracket 14 having previously been fitted to wall 50 by means of screws 20 passing through holes 54. The fitting is then ready for operation.

Preferably, the lamp 90 is positioned so that its longitudinal axis is angled slightly ahead of the vertical. This tends to direct the light emanating from lamp 90 downwardly into the pool. The waves 28 on outer surface 24 of lens 10 and rings 30 on inner surface 26 of lens 10 diffuse the light emanating from lamp 90 so that, to an outside observer, the entire lens 10 appears as the light source rather than just the lamp 90. This reduces glare and further retains the light in the pool.

The lamp 90 is preferably of the quartz halogen type, most preferably quartz-iodide, so that a significant reduction in size can occur. Furthermore, 12 volts could be used so that safety would be increased—even if water entered the fitting.

It is possible to construct a light fitting according to this embodiment of the invention wherein the maximum dimension from the base 30 to the lens is as little as 5 cm. Such a fitting could easily accommodate quartz-iodide lamp of 200 watts capacity. This would result in more light in the pool than a previous light fitting using a 400 watt capacity tungsten-carbide filament lamp. To accommodate such a tungsten-carbide lamp, a light fitting would have to be made from 15 to 20 cm deep which would further increase the inefficiency and thus raise significant cooling problems.

Furthermore, the use of a lamp insertion and removal assembly as has been described means that in order to replace a worn lamp all that needs to be done is to remove the screws 22 and then nut 74 so that the old lamp could be removed and the new lamp inserted.

Figure 6:
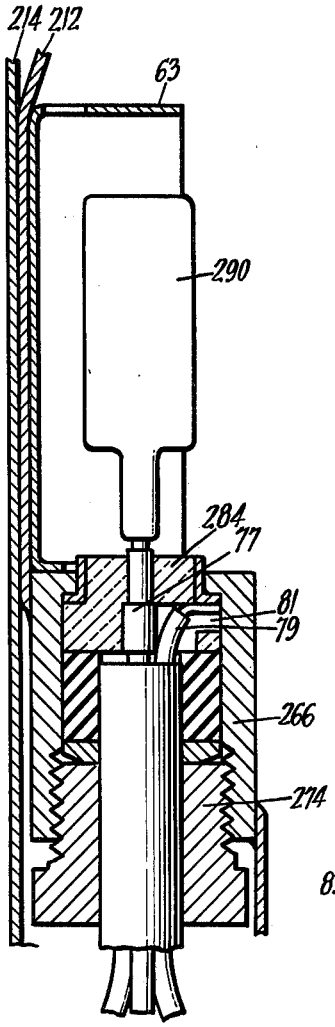
FIG. 6 is a vertical cross-section of the main portion of a second embodiment.
Figure 7:
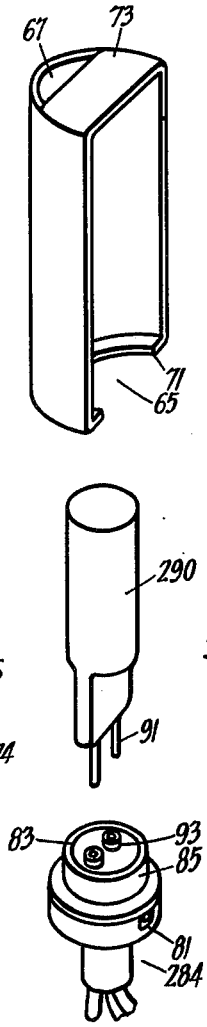
FIG. 7 is an exploded front perspective view of the lamp assembly of FIG. 6.

To refer now to FIGS. 6 and 7, there is shown a second embodiment of the invention with like parts to the embodiment of FIGS. 1 to 5 having the same reference numeral except for the addition of a prefix number 2.

Here, the mounting bracket 214 is exactly as before, as is the base plate 212 and the gland housing 266. Parts not shown or described are as per the embodiment of FIGS. 1 to 5.

The cable 278 in this case is a three wire cable, the first two wires 77 leading to two sockets 93 in upper portion 85 of electrical connecting element 284. These two wires 77 supply the electrical power to operate the lamp 290. The third wire 79 passes through an approximately inverted L-shaped passageway 81 in connecting element 284 such that an electrical connection can be made between the third wire 79 and a conductive sleeve 83 placed over the outer side wall surface of upper portion 85 of connecting element 284. This third wire is an earthing wire. Thus, by having gland housing 266 of a conductive material then the entire light fitting can be properly earthed. The sockets 93 are adapted to releasably receive pins 91 at the lower end of the lamp 290.

There is also shown the use of a reflector 63 mounted on the upper surface of gland housing 266. The reflector is semi-cylindrical with an open front face 69. The reflector 63 is closed at each end with lower end wall 71 having a semi-circular cut-out 65 to enable the lamp 290 to pass into the reflector 63. The top end wall 73 has a small opening 67 therein for normal cooling requirements. All interior surfaces of the reflector 63 would be reflective so that the optimum light output from the lamp 290 may be obtained. The radius of the cut-out 65 would be slightly greater than the external radius of the sleeve 83 on upper portion 85 of connector element 284.

The assembly and operation of the light fitting is the same as for the embodiment of FIGS. 1 to 5.

Figure 8:
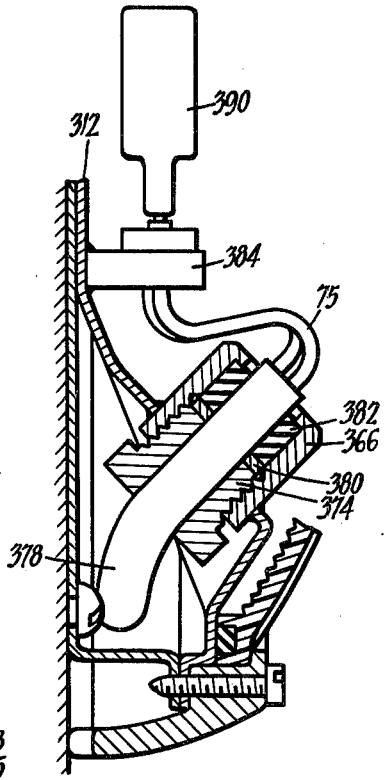
FIG. 8 is a vertical cross-section of the main portion of a third embodiment.

To refer now to FIG. 8, there is shown a third embodiment of the invention, like parts to this embodiment to that of FIGS. 1 to 5 having the same reference numeral but with the addition of the prefix number 3.

This embodiment is exactly the same as that of FIGS. 1 to 5 except that the electrical connecting element 384 is secured to the base plate 312, the lamp 390 being connected to the connecting element 384, as before. Also, the gland housing 366 is inclined outwardly relative to the base plate 312, although the sealing bush 382, washer 380 and nut 374 operate as before. Although the gland housing 366 is shown in only one position, it may be placed in any suitable desired position, direction or location. The cable 378 extends slightly beyond the inner end of the gland housing 366 with the two inner wires 75 continuing to the electrical connecting element. In this way, if any water did seep past the sealing bush 382 and into the light fitting, it would not contact the electrical connections.

The remainder of the light fittings of this embodiment operates as before.

Whilst there has been described in the foregoing description preferred embodiments of the invention, it will be understood by persons skilled in the art that many variations or modifications in details of design or construction may be made without departing from the scope of the invention, the nature of which is to be ascertained from the following claims.

What I claim is:

1. A light fitting for mounted underwater use and comprising an enclosure assembly of watertight integrity including a housing, a backing plate mountable to said housing and locally formed to provide a mounting aperture therethrough, a lens sealingly connected to said backing plate and defining therewith an enclosed chamber, a gland housing secured in said mounting aperture and defining an opening into said enclosed chamber, said opening being of a predetermined transverse dimension, an electrical cable extending within said gland housing and having an electrical connector at one end thereof, a lamp mounted on said electrical connector, and removable sealing means including a nut surrounding said electrical cable to threadedly engage said gland housing and a sealing bush surrounding said electrical cable and adapted to be clamped by said nut for providing a seal between said electrical cable and said gland housing; said lamp, said electrical connector, and said sealing bush having a transverse dimension which is less than said predetermined transverse dimension; said assembly being removable as a watertight unit from its underwater mounting permitting ready removal of said lamp from said chamber through said opening upon removal of said nut and pulling said electrical cable rearwardly from said housing without disturbing the sealed connection between the lens and the backing plate in the removed assembly, and permitting replacement of a lamp in said electrical connector and re-assembly of the lens, electrical connector and sealing bush in said opening upon application of the nut to restore the watertightness of the assembly for remounted underwater use.

2. A fitting as claimed in claim 1, wherein said lens is shaped like a segment of a sphere and has a number of vertically-extending parallel waves on its outer surface, a number of concentric rings or peaks on its inner surface, and a peripheral slot accommodating a seal to seal said lens against said backing plate.

3. A fitting as claimed in claim 2, wherein said housing is shaped like a truncated cone and has a plurality of axially extending lugs at the inner end thereof and a radially inwardly directed peripheral flange at the outer end thereof for accommodating said lens and said backing plate.

4. A fitting as claimed in claim 1, wherein said fitting attaches directly to a wall by means of a mounting bracket.

5. A fitting as claimed in claim 4, wherein said sealing bush is disposed within said gland housing between said nut and said electrical connector with said electrical connector secured to the innermost end of said sealing bush.

6. A fitting as defined in claim 5 wherein the electrical connector is provided with a shoulder cooperating with a shoulder on the gland housing to position the electrical connector under influence of the sealing bush contacting the connector shoulder upon tightening of the nut.

7. A fitting as defined in claim 5 wherein a portion of the electrical connector is interposed between the shoulder and the sealing bush limiting the forward movement of the latter.

8. A light fitting as claimed in claim 1, wherein the transverse dimensions of the opening are less at the end thereof adjacent the enclosed chamber than at the end thereof remote from the enclosed chamber.

9. A fitting as defined in claim 1 wherein said gland housing extends into said enclosed chamber and wherein said gland housing includes a shoulder for limiting the forward movement of said sealing bush.

10. A fitting as defined in claim 9 wherein said sealing bush engages said gland housing shoulder indirectly through said electrical connector.

11. A fitting as defined in claim 1 wherein the sealing bush is in contact with the electrical connector for the sealing purposes and maintaining the connector in position within the gland housing upon tightening of the nut.

* * * * *